United States Patent [19]

Hatch

[11] 4,191,035

[45] Mar. 4, 1980

[54] LOCK

[75] Inventor: George Hatch, Manchester, England

[73] Assignee: Combi-Lock Enterprises Limited, Bolton, England

[21] Appl. No.: 909,058

[22] Filed: May 24, 1978

[51] Int. Cl.[2] ..... E05B 37/16

[52] U.S. Cl. ..... 70/298; 70/315

[58] Field of Search ..... 70/298, 224, 214, 297, 70/287, 288, 315

[56] References Cited

U.S. PATENT DOCUMENTS 1,530,861 3/1925 Standen ..... 70/298

FOREIGN PATENT DOCUMENTS 2003337 8/1970 Fed. Rep. of Germany ..... 70/298

*Primary Examiner*—Robert L. Wolfe

*Attorney, Agent, or Firm*—Ross, Ross & Flavin

[57] ABSTRACT

A combination lock, particularly a domestic door lock, comprises a rotatable and axially movable plunger, a plurality of axially displaceable pins disposed around the plunger, a rotary ward disc carried by the plunger and co-operating with slots in said pins to allow rotary movement of the plunger only when selected ones of the pins are axially displaced, relative to the remainder, to have slots therein aligned with the ward disc, and a member carried by the plunger and capable of moving the pins to an aligned position upon axial movement of the plunger. A user can move said selected ones to render the plunger turnable to open the door and then easily pull or push the plunger to cause said member to re-align the pins to prevent the selected pins remaining depressed and the "combination" visible.

6 Claims, 3 Drawing Figures

LOCK

FIELD OF THE INVENTION

This invention relates to a combination lock, for example for use as a front door lock, or for any other purpose wherein a rotary unlocking and locking motion is desired.

BRIEF STATEMENT OF THE INVENTION

Accordingly the invention provides a combination lock comprising a rotatable and axially movable plunger, a plurality of axially displaceable pins around the plunger, a rotary ward disc carried by the plunger and co-operating with said pins to allow rotary movement of the plunger only when selected ones of the pins are axially displaced relative to the remainder, and a member carried by the plunger and capable of moving the pins to an aligned position upon axial movement of the plunger.

Preferably the lock comprises a cylindrical barrel closed at one end by a front plate, centrally of which a spigot surrounds the outer end of a plunger terminating in a handle and around the spigot a number of equally spaced bore holes allow the heads of the same number of pins to project therefrom.

A ward disc may be carried by the plunger inside the housing and selected ones of the pins may have slots which are aligned with the ward disc when they are displaced.

Each pin may also have a slot in its outer side in the corresponding position.

Advantageously each pin has a central enlarged portion in which both said slots are formed. An outer setting plate carried by the plunger may engage the outer shoulders and an inner resetting plate may engage the inner shoulders.

The end of each pin remote from its head can be prevented from rotation by engagement with a resetting member, this member preferably being movable to allow each pin to be rotated through 180° so as to enable it to be chosen to be one of said selected ones or not as desired. By using the re-setting member the user can effectively select his own combination.

The invention will be described further, by way of example, with reference to the accompanying drawings which illustrate a preferred embodiment, it being understood that the following description is illustrative and not limitative of the scope of the invention.

BRIEF DESCRIPTION OF THE INVENTION

DESCRIPTION OF PREFERRED EMBODIMENTS

Figure 1:
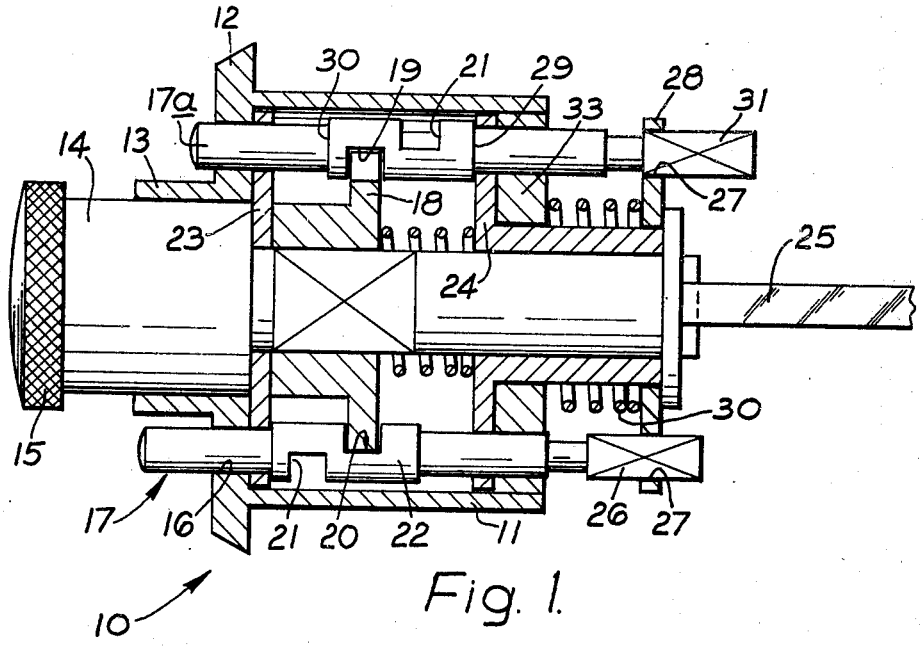
FIG. 1 is a cross-sectional elevation of a first preferred embodiment of lock of the present invention.
Figure 2:
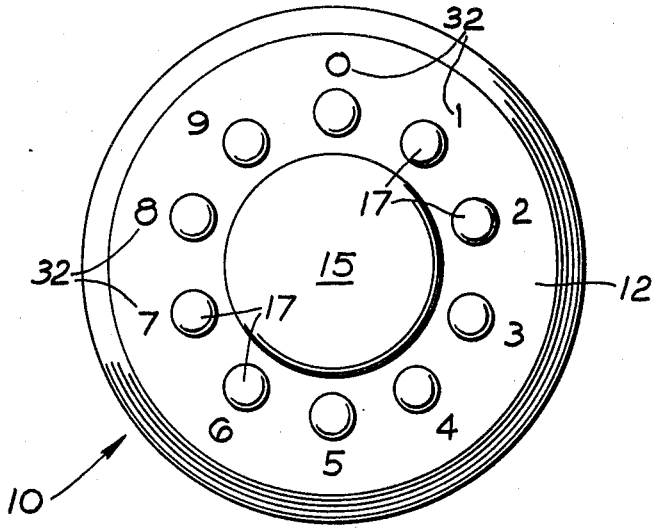
FIG. 2 is an end elevation of the lock of FIG. 1.

A first preferred embodiment of lock 10 of the invention comprises a cylindrical barrel 11 closed at one end by a front plate 12. Centrally of the front plate 12 a spigot 13 surrounds the outer end of a plunger 14 terminating in a handle 15, and around the spigot 13 ten or any other number of equally spaced bores 16 allow the heads of the same number of pins 17 to project therefrom. The pins 17 are axially slidable. A ward disc 18 is carried by the plunger 14 inside the housing and selected ones of the pins 17, for example the upper pin **17*a* in FIG. 1, have slots 19 which are aligned with the ward disc 18 when they are displaced inwardly towards the inner end of the barrel 11. The remainder have slots 20 which are aligned with the ward disc 18 when they are not so displaced. Each of the pins 17 also has a slot 21** in its outer side in the corresponding position.

Each pin 17 has a central enlarged portion 22 in which both said slots 19/20 and 21 are formed and inner and outer shoulders 29, 30 are at each end of the central enlarged portion 22. An outer setting plate 23 carried by the plunger 14 can engage the outer shoulders 30 and an inner resetting plate 24 can engage the inner shoulders 29.

The pins 17 will normally all lie in their inner positions with their outer ends close to the surface of the front plate 12. To open the lock 10 under these circumstances the user pulls the plunger 14 outwardly to cause the inner setting plate 24 to push all the pins 17 to protrude from the front plate 12. He then pushes said selected pins **17*a* (known only to himself) inwards, enabling the ward disc 18 to rotate and thus the plunger 14. A non-circular protrusion 25** on the innner end of the plunger can operate a sliding bolt or the like.

After rotation of the plunger 14 and opening of say, a door, the selected pins **17*a* are still depressed, thus showing the combination. Thus after opening the door the user must depress or pull the plunger 14 to align all the pins 17**.

The user can change the combination very simply. Each pin 17 is rotatably mounted by the barrel assembly 11 and its inner end has a non-circular portion 26 slidable relative to a slot 27 in a slotted circular re-setting member in the form of a plate 28. By pressing this plate 28, to the left in FIG. 1 against the action of a spring 30, the user is enabled to rotate the pins 17 to bring one or other of said slots 27 into its radially inner operative position. The plate 28 can now be returned to the normal locking position. When the combination lock is used in combination with a conventional "Yale" or like slidable bolt on the inside of the door the lock can be made to act as a deadlock or a conventional spring lock by selecting the rotational position of the plunger 14 at which the pins 17 are reset.

The invention is not limited to use in connection with domestic doors, but can be used in any situation where a lockable rotary element is desired. Indicia 31 may be provided on the inner end of the pins 17 to identify the position of the slots 27 when setting the combination. Detent means are provided for retaining the pins in their various axial positions. Indicial 32 may also be provided on the front of the casing in order to identify individual pins.

To secure the lock 10 to a door a front plate 12 can have threaded apertures (not shown) which can receive the ends of set-screws passing through the door from the inside. Alternatively, studs can extend from the plate 12 and be engaged by nuts on the inside of the door.

Figure 3:
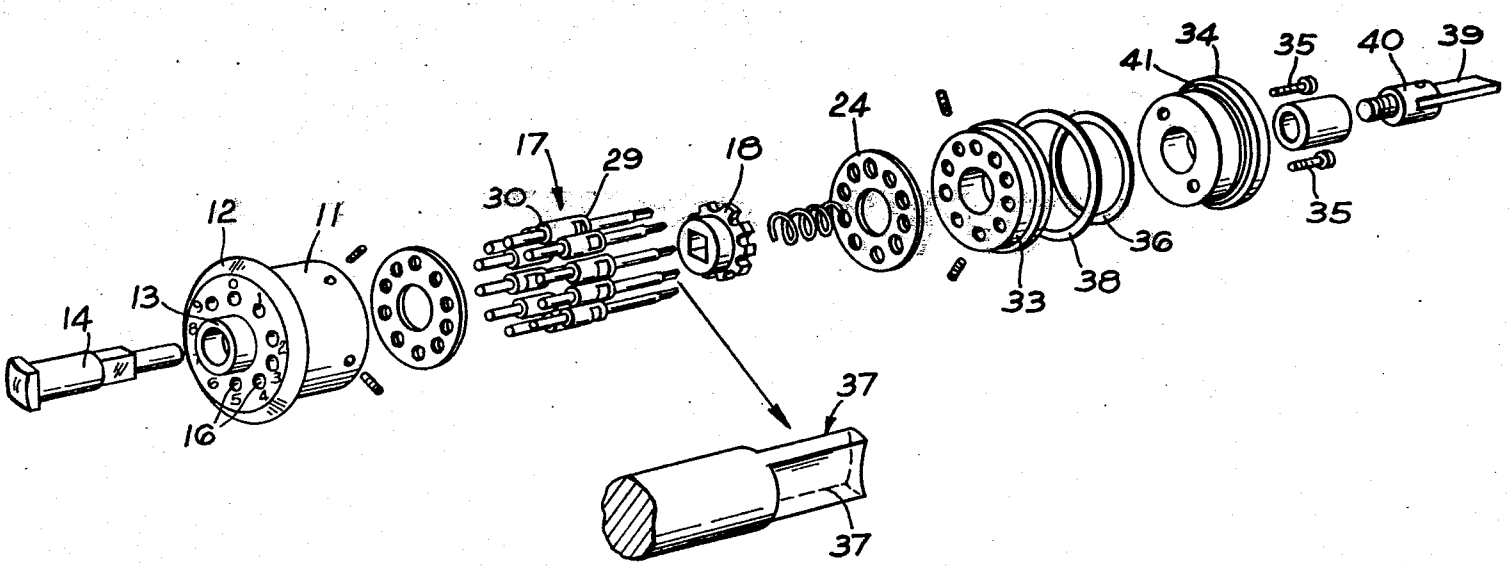
FIG. 3 is an exploded view showing a second embodiment of lock, similar to the lock of FIG. 1, but with a modification.

FIG. 3 illustrates a variation of the lock 10. Plate 24 is a simple annulus and the rear of the lock comprises a closing plate 33 to which a plug 34 is securable by screws 35. An annular groove 41 in plug 34 accommodates a resilient ring 36 against which bears one of two concave surfaces 37 formed in a rear part of each of pins 17. A second resilient ring 38 surrounds the rear parts of pins 17. To re-set the lock of FIG. 3, the screws 35 are removed and plug 34 detached. The desired pins 17 can now be rotated to be part of or out of the group of selective pins 17*a*. The plug 34 is now replaced. A bolt 14 operating tongue 39 is pivotally attached to the inner end of plunger by a split peg 40.

I claim:

1. A combination lock comprising:

a barrel 11, a plunger 14 rotatable and axially movable relative to the barrel, a plurality of axially-displaceable pins 17 mounted relative to the barrel and circumscribing the plunger and each having a centrally enlarged portion defining inner and outer shoulders at respective ends, a rotative ward disc 18 carried by the plunger, an operator-selected number of the pins each having a slot 19 in its respective enlarged portion and alignable with the ward disc when the pins are displaced inwardly and the remaining non-operator selected number of the pins each having a slot 20 in its respective enlarged portion and alignable with the ward disc when the pins are not displaced inwardly, inner and outer setting plates 24, 23 carried by the plunger for engaging the inner and outer shoulders of the pins respectively, with the ward disc cooperating with the pins to allow rotary movement of the plunger only when the selected pins are axially displaced relative to the non-selected pins.

2. A lock as claimed in claim 1, wherein the inner setting plate is displaceable to allow each pin to be rotated through 180° to enable it to be included in the selected number only at the will of the operator.

3. A lock as claimed in claim 2, including a resetting plate, and wherein each pin has a rectangular rear end portion engaged in a slot in the resetting plate, the resetting plate being displaceable against the action of a spring to disengage the rectangular end portions for re-setting.

4. A lock as claimed in claim 3, with the resetting plate being in the form of a plug having a cylindrical outer surface and detachably secured to the barrel, each pin having two complementary curved convex surfaces at its rear end spaced 180° apart for enabling one or other to be disposed adjacent the plug.

5. A lock as claimed in claim 4, with a resilient ring located in an annular groove in the plug.

6. A lock as claimed in claim 5, with a second resilient ring surrounding the rear end portions of the pins.

* * * * *